US007509941B2

(12) United States Patent
Ottosson et al.

(10) Patent No.: US 7,509,941 B2
(45) Date of Patent: Mar. 31, 2009

(54) APPARATUS AND METHOD FOR ADJUSTING AIR-TO-FUEL RATIO FOR SMALL GASOLINE ENGINE

(75) Inventors: Lars Ottosson, Tosse (SE); Jorgen Bengtsson, Svanskog (SE); Bert Gustafsson, Amal (SE)

(73) Assignee: Phelon Euro AB, Amal (SE)

( * ) Notice: Subject to any disclaimer, the term of this patent is extended or adjusted under 35 U.S.C. 154(b) by 0 days.

(21) Appl. No.: 11/714,679

(22) Filed: Mar. 6, 2007

(65) Prior Publication Data

US 2007/0209635 A1 Sep. 13, 2007

Related U.S. Application Data

(60) Provisional application No. 60/791,671, filed on Apr. 13, 2006, provisional application No. 60/780,964, filed on Mar. 8, 2006.

(51) Int. Cl.
*F02M 7/10* (2006.01)

(52) U.S. Cl. ..... 123/438; 123/439; 123/406.45; 123/406.57; 123/596; 123/599

(58) Field of Classification Search ..... 123/406.45, 123/438, 439, 406.57, 596, 599
See application file for complete search history.

(56) References Cited

U.S. PATENT DOCUMENTS 3,931,814 A 1/1976 Rivere
5,031,593 A * 7/1991 Erhard et al. ..... 123/331
5,301,644 A 4/1994 Olmr
5,611,312 A * 3/1997 Swanson et al. ..... 123/436
5,809,971 A 9/1998 Svensson et al.
6,273,065 B1 8/2001 Carpenter
6,401,685 B1 6/2002 Warner
2004/0089259 A1 5/2004 Tharman et al.

FOREIGN PATENT DOCUMENTS

DE 2348638 4/1974
DE 3038706 8/1982
DE 3818632 12/1989

(Continued)

OTHER PUBLICATIONS

International Search Report dated Nov. 27, 2007 in co-pending PCT application filed in the EPO.

(Continued)

*Primary Examiner*—Erick Solis
(74) *Attorney, Agent, or Firm*—Nelson Mullins Riley & Scarborough LLP

(57) ABSTRACT

An apparatus and method for use with a carbureted internal combustion engine that accurately controls the amount of fuel that passes through the carburetor into the combustion chamber of the engine. A controlled triggering system controls the activation and deactivation of a solenoid. The solenoid, in turn, operates a plunger that varies the flow of fuel during the fuel intake cycle of the engine depending on the amount of fuel needed by the engine under any operating load. Thus, an engine can run leaner under partial load and run richer during periods of load and acceleration. By controlling the air-to-fuel ratio lower engine emissions and fuel consumption can be achieved.

20 Claims, 6 Drawing Sheets

FOREIGN PATENT DOCUMENTS

| | | |
|---|---|---|
| DE | 19607165 | 8/1997 |
| EP | 61087957 | 5/1986 |
| EP | 0853189 | 7/1998 |
| EP | 1353058 | 10/2003 |
| JP | 63131856 | 6/1988 |
| JP | 08319892 | 12/1996 |
| JP | 2002235605 | 8/2002 |
| WO | 2007065701 | 6/2007 |

OTHER PUBLICATIONS

Co-pending U.S. Appl. No. 11/776,850, filed Jul. 12, 2007, entitled "Apparatus and Method for Ignition Timing for Small Gasoline Engine".

Pending U.S. Appl. No. 11/589,673, filed Oct. 30, 2006.

German Patent Application DE 102005059080, filed Dec. 10, 2005 in the name of Bing Power Systems GmbH and R.E. Phelon Company, Inc. Translation attached.

Partial international search dated Jul. 13, 2007 in co-pending PCT application filed in the EPO.

* cited by examiner

APPARATUS AND METHOD FOR ADJUSTING AIR-TO-FUEL RATIO FOR SMALL GASOLINE ENGINE

PRIORITY CLAIM

This application claims the benefit of provisional application Ser. No. 60/780,964 filed Mar. 8, 2006 and provisional application Ser. No. 60/791,671 filed Apr. 13, 2006, both of which are hereby relied upon and incorporated herein by reference.

BACKGROUND OF THE INVENTION

The present invention generally relates to the control of the air/fuel mixture for small gasoline engines that utilize a carburetor, or some other means of providing fuel into the air stream using a venturi. More particularly, the invention relates to an apparatus and method for regulating the flow of fuel into the air stream using a fast acting solenoid. By controlling the flow of fuel into the air stream, the air-to-fuel (A/F) ratio can be controlled to ensure that the engine operates efficiently under varying loads.

It is well known that the A/F ratio for a typical low revolutions per minute (RPM) air cooled engine used on walk behind mowers, riding mowers and other equipment can be controlled by a carburetor. When the operator increases the RPM with a RPM-demand lever, the engine's throttle plate adjusts to meet the RPM demand and normally a RPM governing system continuously adjusts the throttle plate to meet the set RPM regardless of engine load.

Since engines of this type normally are air cooled, the A/F ratio is configured to get maximum power output without overheating the engine at maximum load. As such, the carburetor calibration normally is such that access to fuel is provided for assisting the cooling of the engine. Since carburetors typically used in these types of applications are of a fairly simple design, features that can enrich the fuel are not present. Due to this and other factors, the same A/F ratio that the engine requires operating at full load will often be supplied to the combustion chamber even when operating at lesser loads. When engines operate at lesser loads, the cooling effect from the fuel is not required; the result is an air-to-fuel mixture that is "rich"—or contains more fuel than needed—for partial load operations.

While using a rich mixture protects against overheating and assists the engine in reacting quickly to increased load demands, it also increases emissions and fuel consumption. With most engines of this type being operated predominantly at partial load, the A/F mixture does not need to be as rich. Thus the emissions and fuel consumption from engines operating at partial load are higher than if the A/F ratio could be adjusted leaner during partial load operation.

An additional problem can occur in small engines due to the lack of control over the flow of fuel into the combustion chamber of the engine. Many small engines are designed such that the exhaust valve remains open for a short time after the intake valve opens. Thus, for a brief period, unburned fuel can pass directly through the exhaust valve into the exhaust system. When fuel passes through the engine without contributing to combustion, the engine is not using fuel efficiently, and emissions will be increased.

It is well known that currently existing technology provides two main techniques for controlling the A/F ratio. One technique is through Electronic Fuel Injection (EFI) that can control A/F ratio cycle-to-cycle. EFI systems, however, are costly to implement due to the high complexity compared to a carburetor. The other common technique used to control the A/F ratio is by using an "air bleed system" that indirectly controls the fuel flow to the air stream. This system, however, usually cannot adjust on a cycle-to-cycle basis and also has longer delay times associated with the physics involved with the mixture adjustment.

SUMMARY OF THE INVENTION

The present invention recognizes and addresses the foregoing considerations, and others, of prior art construction and methods. Accordingly, it is an object of the present invention to provide an improved apparatus and method for the regulation and control of the A/F ratio in an engine.

In one aspect, the present invention provides an apparatus for use with a carburetor on a small engine to control the opening and closing of at least one carburetor fuel path (e.g. jet). The apparatus comprises at least one solenoid that acts to open and close the fuel path. The solenoid controls the operation of a pin—or "plunger"—that acts as a plug to the fuel path. The apparatus further comprises an electronic switching element which allows energy generated preferably by the turning of the flywheel to flow into the solenoid. The apparatus optionally comprises one power source, or in some embodiments several power sources, such as a battery, capacitor or equivalent, which stores energy sufficient to operate the solenoid(s). Finally, the apparatus comprises some control logic (CL) which operates the electronic switching element, thereby directing current to the solenoid at selected intervals.

In another aspect, the present invention provides a method of controlling the opening and closing of the fuel path on a carburetor as to accurately control the amount of fuel that flows into the engine's combustion chamber during a single combustion cycle. The CL can receive data regarding the quality of the combustion from sensors placed in the combustion chamber or in the exhaust system. Using this data, along with information about the speed of the engine a closed loop control of A/F ratio can be achieved. The CL activates and deactivates the solenoid which opens and closes the fuel path pin such that the amount of fuel flowing into the combustion chamber is varied according to the target value for A/F ratio. The control is not limited to be a close loop control. The invention can be controlled based on different sensors and is not limited to any given control strategy.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
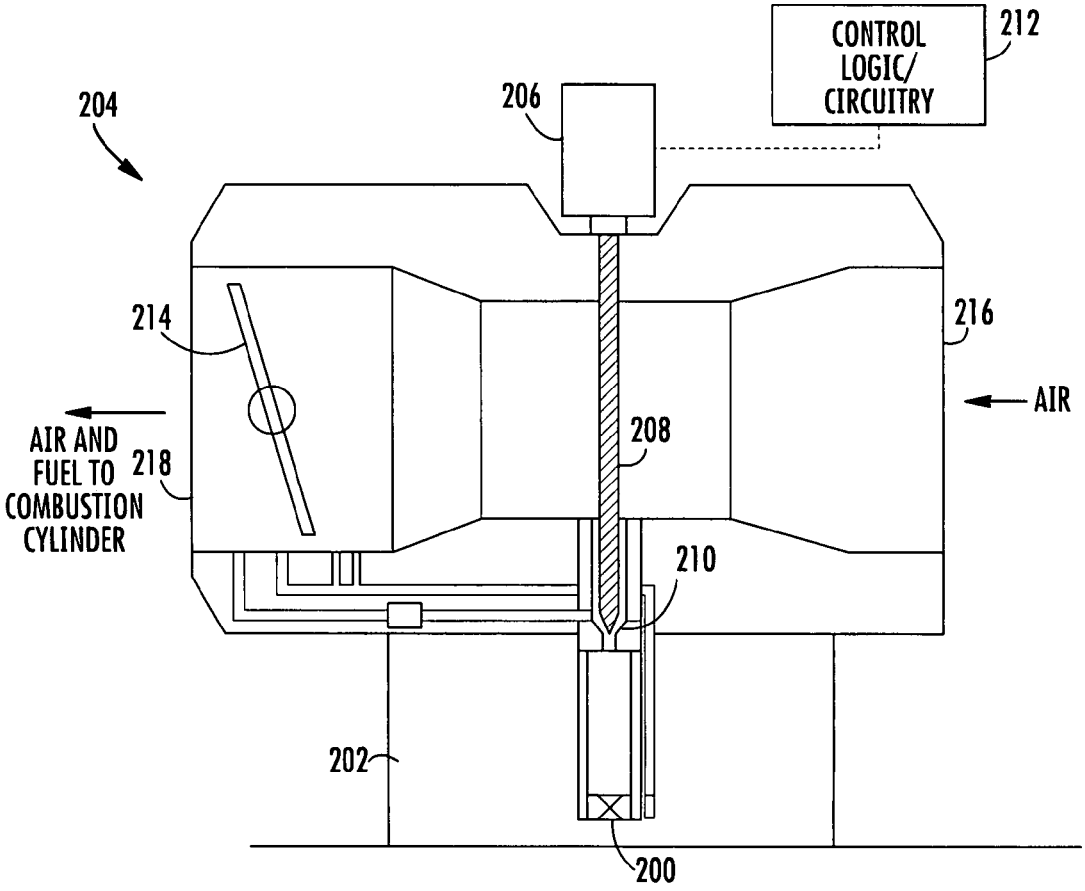
FIG. 1 is a diagrammatic representation of a carburetor including an air-to-fuel ratio control system in accordance with the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations.

Many engines have a fuel shut-off solenoid on the carburetor operated by a voltage supplied by a battery. The function of the solenoid is to open the fuel flow into the carburetor when voltage is applied. When the engine is stopped the voltage will be removed and the solenoid will close to prevent fuel from reaching the combustion chamber. The fuel shut-off solenoid performs this function by sealing the carburetor mixing tube so fuel is prevented from mixing with the air. The present invention recognizes that the fuel shut-off function of the solenoid can be controlled and synchronized to the crankshaft rotation so that it can be used for fuel control during engine operation. By controlling fuel flow, the A/F ratio can be regulated.

A 4-stroke engine running at 3000 RPM will have a 25 Hz firing frequency and also a 25 Hz fuel intake frequency. The fuel window if the valves are open the entire inlet stroke is approximately 10 ms at 3000 RPM. Therefore, shortening this fuel window will shorten the amount of fuel transferred into the cylinder. If the fuel flow is proportional to the time and a fuel reduction of 20% is needed, the fuel window should be reduced by 2 ms.

A normal fuel shut-off solenoid that operates with the battery as its power source will have a delay time of at least 5 ms from the stroke command until the stroke is finished. This delay time consists of two portions: (1) delay due to the necessary build up of electromechanical force overcoming friction and spring forces, and (2) the time for the actual movement of the armature. The magnitude of this tolerance will be in the order of 10% due to variation in armature mass, winding resistance, spring forces, friction, operating temperature supply voltage and others. As understood a solenoid with a long delay time cannot be used when accuracy of the fuel control is required.

The following formulas are valid for a solenoid:

$$F=(N\cdot I)^2\cdot k \qquad \text{Eq. 1}$$

Where:

F=Force

N=Winding turns

I=Supply current k=constant

The constant (k) will depend upon the design and for a given design it can be disregarded:

$$U = R\cdot I + L\cdot\frac{dI}{dt} \qquad \text{Eq. 2}$$

This is valid during initiation of the current when time T<<L/R when an approximation of ΔI/ΔT can be calculated as:

$$\frac{\Delta I}{\Delta T} = \frac{U}{L} \qquad \text{Eq. 3}$$

Where:

U=Voltage

L=Inductance

I=Supply Current $$\frac{\Delta I}{\Delta T} = \text{Current rise}$$

R=Solenoid winding resistance $$L=N^2\cdot k \qquad \text{Eq. 4}$$

Where:

L=Inductance

N=Winding turns k=Mechanical constant

The mechanical constant (k) depends upon mechanical design and material but for the same mechanical design this value can be assumed constant.

Finally, as an approximation if time T much smaller than L/R:

$$U = N^2\cdot k\cdot\left(\frac{\Delta I}{\Delta T}\right) \qquad \text{Eq. 5}$$

Giving that $$\frac{\Delta I}{\Delta T} = \frac{U}{N^2}\cdot\frac{1}{k} \qquad \text{Eq. 6}$$

and if k is constant:

$$\frac{\Delta I}{\Delta T}$$

only varies with $$\frac{U}{N^2}$$

Where:

U=Voltage

N=Winding turns k=Mechanical constant $$\frac{\Delta I}{\Delta T} = \text{Current rise}$$

Note that initially the current rise will only depend upon voltage and inductance as U/L.

Based on these equations it should be apparent to those skilled in the art that by increasing supply voltage, delay time will be reduced. This fact allows for a design where a higher number of winding turns are used which serves to increase the winding resistance. When the stroke of the solenoid is completed all input energy will be in the form of heat that needs to be dissipated by the winding. Therefore the winding resistance needs to be kept at a high enough value such that the current is limited to a safe level. To achieve the same response time with a low supply voltage (e.g., 12V) the resistance needs to be low. Thus, without an active current control the heat build-up in the winding will be too high.

The present invention makes it possible to combine a short delay time through the use of a low energy, high voltage power source to energize the solenoid. Furthermore, the power dissipation in the present invention is self controlled due to the limited energy dissipated to the solenoid. When voltage is high the number of winding turns can be kept high. A high number of winding turns creates a high resistance making this solenoid also suited to be used with a lower voltage (i.e., 12V) without using active current control. Therefore, the high initial voltage causes the solenoid to be fast acting while the low sustaining voltage provides that the solenoid can be energized for a long time without overheating.

In order to regulate the A/F ratio in an open loop manner without using an oxygen sensor, a solenoid with a low delay time is needed in order to reach proper levels of accuracy. A low delay time is needed since there is a correlation between the time the solenoid takes to start and stop the fuel flow and the change in A/F ratio. Accordingly, on applications where the reduction of the A/F ratio is based on load, RPM, or some other factor, the accuracy of the opening and closing time of the solenoid will be a relatively large portion in the deviation in A/F ratio.

In order to reduce the solenoid's delay time previously described (1) a higher supply voltage should be used and (2) the mass of the armature should be kept as low as possible to reduce the actual stroke time. The present invention uses the principle that if the solenoid supply voltage increases then the current for the same resistance will also increase. Since the build-up of the magnetic force depends upon current rise time, $\Delta I/\Delta T$ should be high. The actual force created by the solenoid depends upon the product of current in the winding and the number of winding turns. A high supply voltage makes it possible to achieve a high $\Delta I/\Delta T$ with a higher number of winding turns such that a higher magnetic force is achieved.

In one preferred embodiment, the system uses energy stored in a high voltage capacitor to generate the initially needed high current rise to overcome the first delay factor and start the stroke of the armature. When energy stored in the capacitor is limited, the supply voltage will quickly drop down. Since the force needed to move the plunger decreases with a decrease in distance from the plunger seat, the voltage needed to maintain an adequate force also decreases. Thus, a low voltage power source can be engaged to either complete the stroke or to hold the plunger in its inner position. Furthermore, in some embodiments the system will utilize components of the vehicle's ignition system.

FIG. 1 shows a carburetor 204 including an air-to-fuel control system in accordance with certain aspects of the present invention. A jet 200 delivers fuel from fuel chamber 202 into carburetor 204. Solenoid 206, plunger 208, and plunger seat 210 are associated with jet 200. A valve is created with plunger 208 selectively engaging and disengaging plunger seat 210. Valve control logic and circuitry 212 operates solenoid 206. As throttle valve 214 rotates, air enters first opening 216. If the valve is open, fuel will mix with the air. The air and fuel mixture will then exit carburetor 204 through second opening 218. This mixture then enters a combustion chamber. An exemplary carburetor which may utilize principles of the present invention is described in PCT application no. PCT/EP2006/011839 to Bing Power Systems GmbH and R.E. Phelon Company, Inc., incorporated herein by reference.

Figure 2:
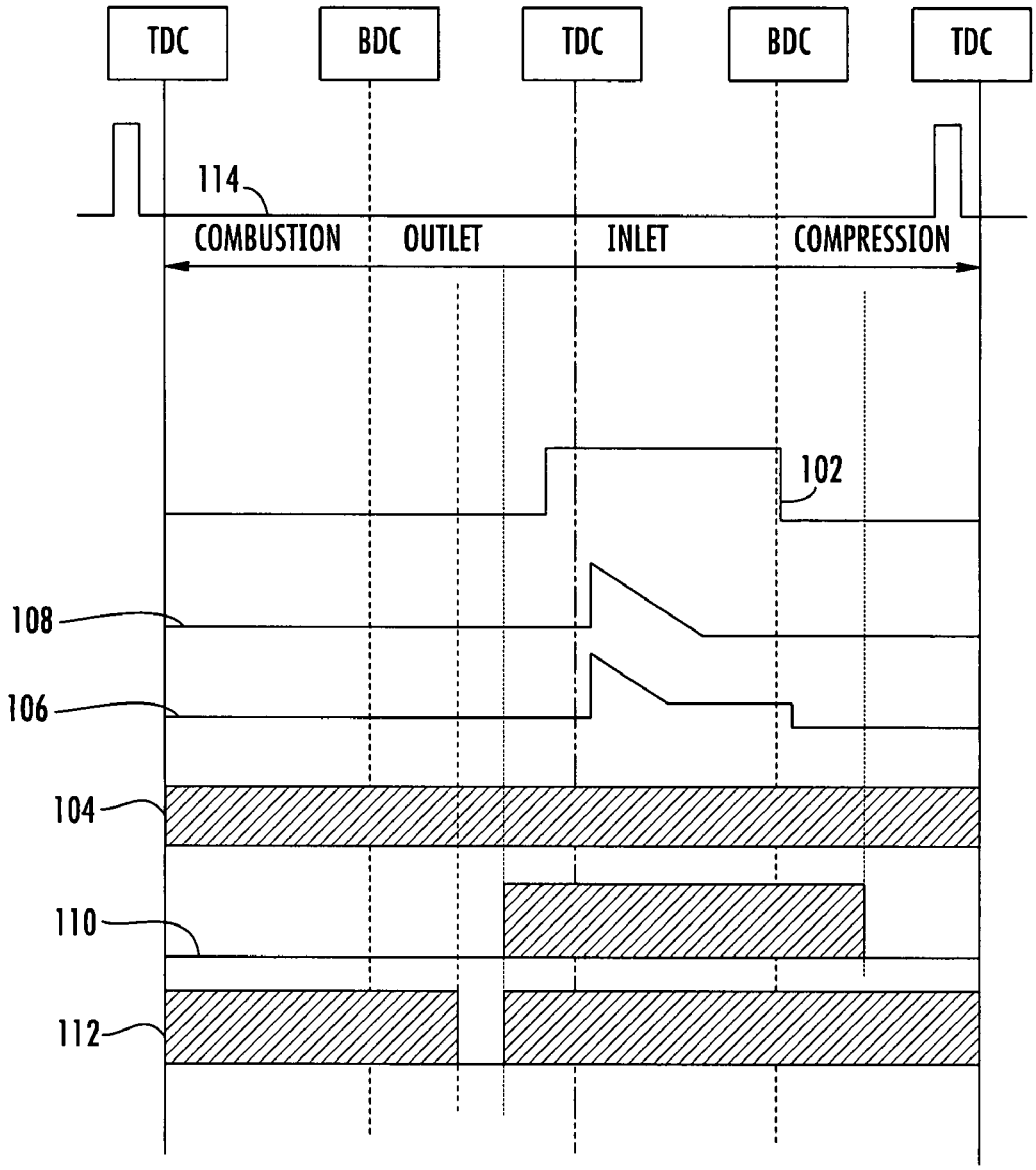
FIG. 2 is a graphical presentation of the sequence of one complete 4-stroke engine cycle of 720 crank shaft degrees.

FIG. 2 is a graphical presentation of the sequence of one complete 4-stroke engine cycle of 720 crank shaft degrees. Timing plot 114 demonstrates the electric spark timing ("EST") in a 4-stroke engine cycle. "TDC" refers to the position of the piston at top dead center and "BDC" refers to the position of the piston at bottom dead center. As can be seen, the fuel window 102 is the period that begins with the opening of the intake (inlet) valve, creating a flow of air that draws fuel through the carburetor and into the combustion chamber. In some embodiments, this fuel window 102 may be longer than the inlet valve opening. For instance, if there is a large air plenum between carburetor outlet 218 and the combustion chamber, it will average the air pulsation so the fuel window may be longer than the inlet valve opening. The fuel window may also vary due to throttle plate opening.

The control of fuel flow can be accomplished by controlling the opening or closing of the solenoid within the fuel window. Accordingly, fuel flow can be controlled by adjusting the opening point or closing point of the solenoid (or both the opening and closing point) which controls fuel flow. By adjusting the fuel flow within the fuel window, the A/F ratio can be adjusted upon demand.

The fuel flow supplied by the carburetor is dependent upon the air speed over the venturi or the lower pressure present in front of the throttle plate. Some types of engines, in particular single cylinder engines, experience a large pulsation of the air flow when the air path to the combustion chamber is open only a part of the complete engine cycle. Back pressure can occur in the system that can alter the air flow and subsequently alter fuel flow. In accordance with the present invention, the opening and closing of the fuel path can be synchronized to the angular position of the engine. Thus, the fuel path can be closed during the period where back pressure can occur. In one relatively simple configuration, the fuel path in the present invention is timed to open during the time period that the inlet valve is opened. As discussed herein, the opening of the fuel path can also be controlled more precisely to control the air-to-fuel ratio.

Fuel can only flow from the fuel reservoir into the carburetor, and thus into the engine's combustion chamber, when the fuel flow path is open. Timing plot 104 illustrates the opening of the fuel path via the fuel shut-off solenoid according to the prior art. As plot 104 makes clear, in the prior art the fuel path through the main jet is open at all times while the engine is running. Because the main jet is the only path through which fuel flows from the fuel reservoir into the mixing tube and then the air steam in a typical small engine application, the main jet is tuned to deliver the amount of fuel that is needed by the engine when operating with full load air flow. A small engine, however, often runs at less than a full load. Accordingly, under the prior art operation that timing plot 104 exemplifies, the engine typically receives more fuel than is necessary when operating at less-than-full load, and as such, does not operate fuel or emission efficient at lesser loads.

Timing plots 108 and 106, where timing plot 108 is with only one power source and timing plot 106 is with two power sources, demonstrate the timing of fuel flow from the main jet into the engine's combustion chamber according to the present invention. Specifically, timing plots 108 and 106 represent the current flow in the solenoid. The plots indicate that the present invention can open the main jet at some point after fuel window 102 opens, but before fuel window 102 closes. By controlling the opening and, if needed, the closing time of the main jet relative to fuel window 102 opening, the present invention precisely regulates the amount of fuel that flows through the carburetor and into the engine depending on the engine's need at a given time. It can also be seen in FIG. 2 that the solenoid operating windows 110 and 112 are bigger than the fuel window. Therefore, the invention is not limited to embodiments in which the solenoid is operating only within the fuel window.

With a fast acting solenoid, the delay time from the stroke command to fully open is generally in the order of 1 ms. Shortening of the delay time decreases the inaccuracy of A/F ratio caused by the tolerances of the time it takes for turning on and off the solenoid. Precise control over the opening and closing of the fuel path is one significant aspect of the present invention. By opening the fuel path for a controlled time during the fuel intake cycle, the present invention assumes precise control over the amount of fuel that enters the combustion chamber. The end result of this control is that when the engine is operating at less than full load, less fuel flows into the combustion chamber than under the prior art. By accurately controlling the solenoid, the present invention ensures that the engine receives a more precise amount of fuel necessary for efficient operation.

The present invention solves an additional problem over the prior art. Many small engines experience a period of "short circuiting" when the path for exhaust gases remains open for a short time during the inlet stroke. Under the prior art, during this "short circuiting" period some unburned fuel passes directly into the exhaust system without participating in the combustion cycle. According to the present invention, however, the main jet can be closed while the exhaust valve is open, thus preventing fuel from flowing into the combustion chamber until after the exhaust valve closes. By holding the fuel path closed during the early portion of the intake window, the present invention reduces the fuel flow during the sequence where short circuiting can occur.

Figure 3:
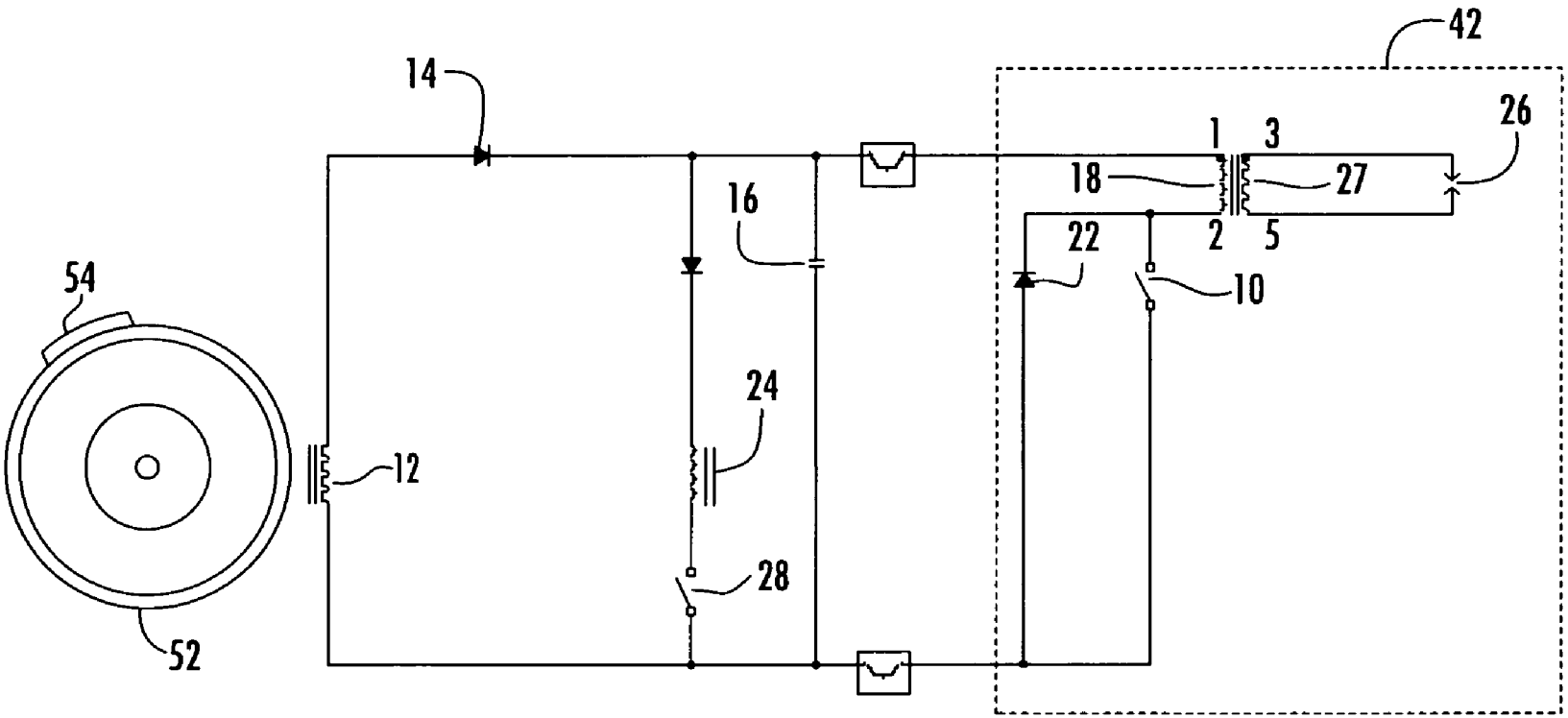
FIG. 3 is a circuit diagram of an exemplary power circuit constructed in accordance with an embodiment of the present invention.

Referring now to FIG. 3, a charge coil 12 is positioned such that a magnet 54 on the flywheel 52 will pass by in close proximity. Coil 12 induces a voltage that is rectified by a rectifier diode 14 and stored by capacitor 16. Control logic is used to recognize the engine position and determine the engine phase. For a combustion turn, capacitor 16 is discharged through a primary coil 18 and a first switching element 10. Switching element 10 is controlled by the CL to allow conduction through primary coil 18 at the appropriate time. A spark is thus generated at a spark plug 26 by a secondary coil 27. One skilled in the art will appreciate that the CL can be implemented using hardware, firmware, software or combinations thereof, depending on the requirements of a particular application.

The next engine revolution is a waste turn meaning that no spark is needed at spark plug 26. Capacitor 16 is again charged when the magneto passes by charge coil 12. During this waste turn the CL commands second switching element 28 to close. Switching element 28 can be any suitable electronic switching element, such as an insulated gate bipolar transistor (IGBT) or an SCR. When switching element 28 is closed, a solenoid 24 will be energized by capacitor 16 and the armature of solenoid 24 will move. In a preferred embodiment, solenoid 24 will also function as the fuel shut-off solenoid associated with the carburetor.

In many embodiments, the CL will also function to turn off solenoid 24 by opening switching element 28. By turning off the solenoid, fuel flow will also be stopped. The timing of this step will depend upon the required change in fuel flow as determined by the performance demands of the engine. The operating window will be similar to operating window 110 as shown in FIG. 2 and a timing plot similar to timing plot 108 as shown in the same figure.

Figure 4:
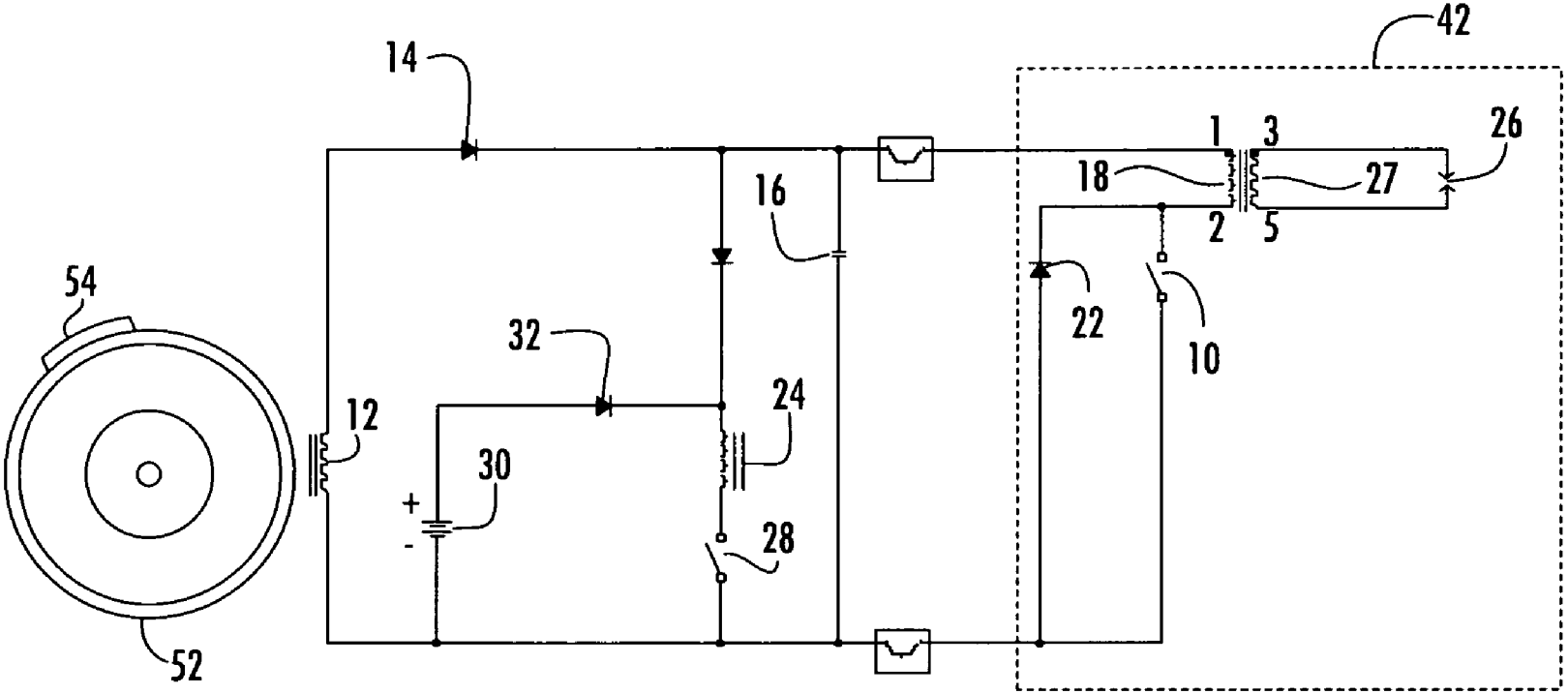
FIG. 4 is a circuit diagram of an exemplary power circuit including a second power source constructed in accordance with another embodiment of the present invention.

Referring now to FIG. 4, if energy stored in capacitor 16 is not sufficient to keep solenoid 24 active throughout the time needed, then a second power source 30 could be used. Second power source 30 can be any suitable energy supplying means, such as a battery. As shown, second power source 30 is preferably connected to solenoid 24 via a diode 32. With this configuration, the energy stored in capacitor 16 will energize solenoid 24 when switching element 28 closes and then second power source 30 will hold the solenoid armature in its energized position until switching element 28 opens. The operating window will be similar to operating window 110 as shown in FIG. 2 and a timing plot similar to timing plot 106 as shown in the same figure.

Solenoids have an internal spring that biases the armature in a first direction. Movement of the armature in the second direction is electrically controlled. Thus, fuel flow can be controlled by solenoid 24 using two different options. According to a first option, the solenoid armature spring force closes fuel flow. Utilizing the spring to close fuel flow is generally the preferable solution for the fuel shut-off function. As soon as solenoid 24 is not energized, fuel flow will be restricted. When this solution is used the time the solenoid needs to be open for maximum fuel flow is often too long for just using the energy stored in capacitor 16. Therefore, use of second power source 30 is generally needed.

According to the second option, the solenoid spring force opens fuel flow. This solution makes it possible to just activate solenoid 24 when fuel flow needs to be restricted. The spring biasing force keeps the fuel flow at the maximum setting calibrated by the carburetor main jet. This solution is generally preferable for applications when the energy stored in capacitor 16 will be sufficient for the time the fuel flow needs to be restricted and a second power source 30 is not used.

A preferred strategy for reduced emissions is to run the engine on standard carburetion and restrict fuel flow at lower engine loads. Thus, if the spring force closes fuel flow the solenoid must be energized most of the time to not restrict the flow. Using the arrangement shown in FIGS. 3 and 4 switching element 28 would be closed all the time and the voltage induced in charge coil 12 would be a short circuit through solenoid winding 24 and switching element 28. In these circumstances, the ignition system may not work properly.

Figure 5:
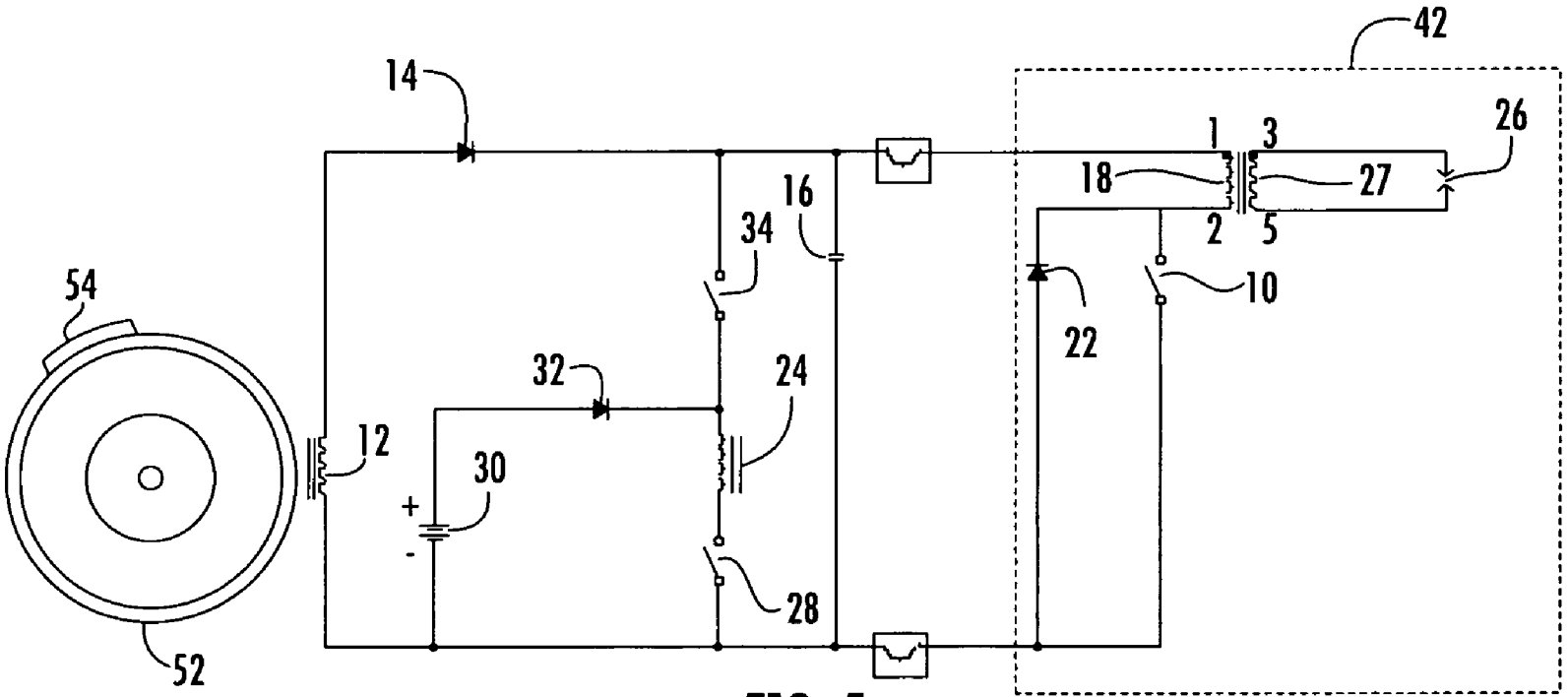
FIG. 5 is a circuit diagram of an exemplary power circuit including a second power source and switching system in accordance with another embodiment of the present invention.

Referring now to FIG. 5, in order to alleviate the short circuit concern an additional switching element 34, preferably an SCR, is utilized. Switching element 34 can be opened and closed so that the functionality of the ignition system 42 is maintained at all times. Thus, switching element 34 can be controlled so that short circuiting of the charge voltage is prevented even when the solenoid is active. Specifically, switching element 34 can be turned off after the energy in capacitor 16 is dissipated. This functionality also allows for a larger operating window 112 and associated timing plot 106 as shown in FIG. 2. In some embodiments of the present invention, switching element 28 and switching element 34 are both controlled by one output pin from the control logic.

Figure 6:
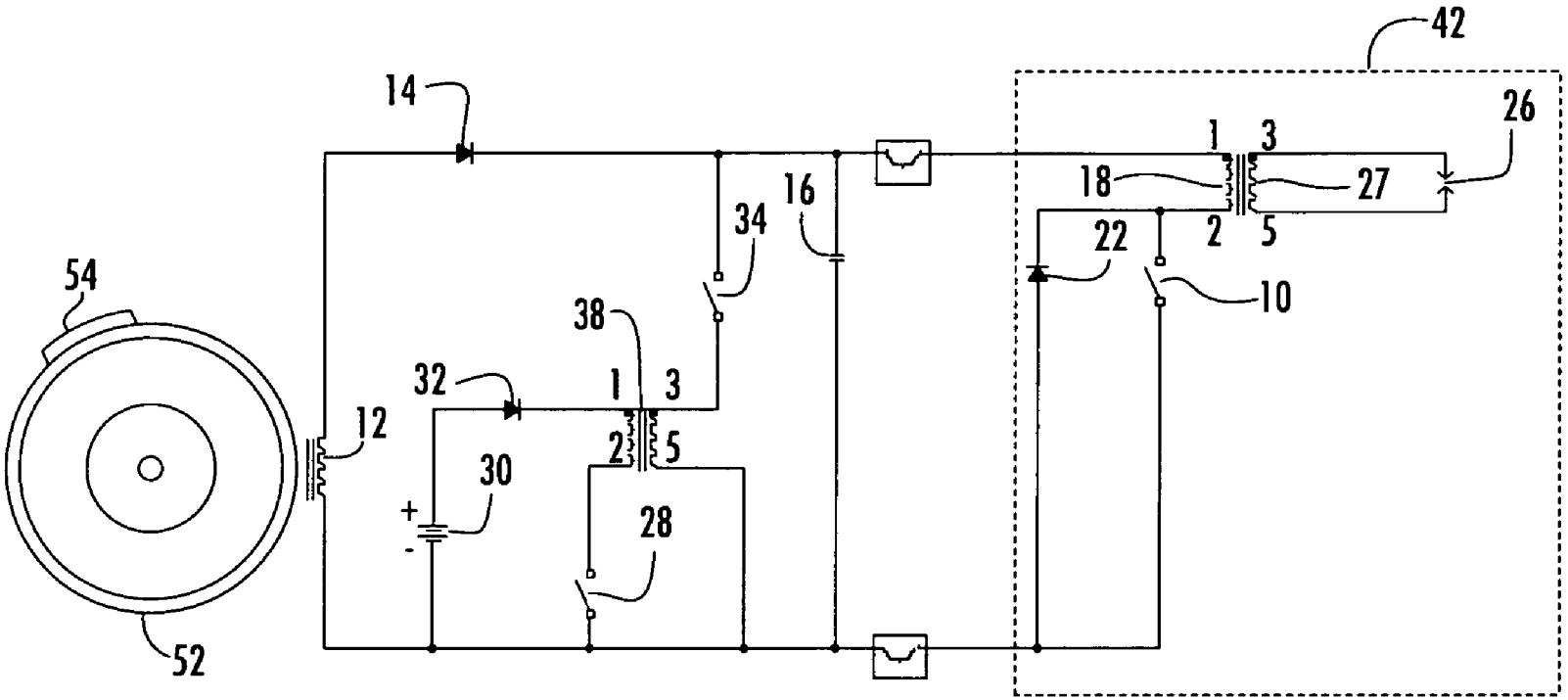
FIG. 6 is a schematic diagram of another exemplary power circuit constructed in accordance with another embodiment of the present invention.

FIG. 6 illustrates another solenoid control circuit constructed in accordance with the present invention. This embodiment includes a solenoid with a plurality of windings 38. In this embodiment, the CL enables switching element 34 which allows current to flow into one of the windings of solenoid 38. This winding opens the fuel path plunger, allowing fuel to flow into the engine's combustion chamber. Once the plunger is open, the CL turns on switching element 28, which allows current from second power source 30 to flow through a different winding of solenoid 38, holding the plunger open. To close the plunger, the CL turns switching element 28 off (i.e, opens switching element 28). The CL turns switching element 34 open as soon as the energy in capacitor 16 is drained. The spring then pulls the main jet plunger closed, plugging the main jet and preventing fuel from flowing into the combustion chamber of the engine. The resulting operating window will be similar to operating window 112 as shown in FIG. 2.

It would be appreciated by those skilled in the art that the circuit represented in FIGS. 3, 4, 5, and 6 without the primary coil 18, secondary winding 27, switching element 10, and an anti-parallel diode 22 could be used as a dedicated power source for solenoid 24. This type of configuration would also increase the operating window to a period similar to the window shown by operating window 112 for the circuits represented in FIGS. 3 and 4.

It can thus be seen that the present invention provides an apparatus and method for adjusting A/F ratio in a small internal combustion engine. While one or more preferred embodiments of the invention have been shown and described, modifications and variations may be made thereto without departing from the spirit and scope of the invention. For example, embodiments of the invention are contemplated utilizing a solenoid or stepper motor capable of achieving and maintaining a range of intermediate positions for the carburetor plunger (in addition to open or closed). It should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made.

What is claimed is:

1. An apparatus for use with an internal combustion engine for adjusting air-to-fuel ratio, said apparatus comprising:

a carburetor for mixing air and fuel;

said carburetor including at least one fuel path for introduction of fuel;

a valve associated with said fuel path, said valve having an open position and a closed position such that said open position allows fuel flow and said closed position impedes fuel flow; and valve control circuitry operative to vary air-to-fuel ratio in said carburetor by controlling said valve during engine operation, said valve control circuitry including a charge capacitor in an ignition circuit having high-voltage energy stored thereon to at least assist in movement of said valve.

2. An apparatus as set forth in claim 1, wherein said fuel path is a jet.

3. An apparatus as set forth in claim 2, wherein said valve control circuitry controls said air-to-fuel ratio by modulating opening of said valve.

4. An apparatus as set forth in claim 3, wherein said valve comprises a plunger engaging a valve seat, said plunger forming part of a solenoid.

5. An apparatus as set forth in claim 4, wherein said valve control circuitry includes a switch operative to selectively provide a flow of current to said solenoid.

6. An apparatus as set forth in claim 1, wherein said valve is intermittently closed during said engine operation.

7. An apparatus as set forth in claim 6, wherein said engine is a 4-stroke engine and said valve is closed during at least some of a 4-stroke sequence thereof.

8. An apparatus as set forth in claim 7, wherein said valve is closed during at least a portion of a combustion stroke of said 4-stroke sequence.

9. An apparatus as set forth in claim 7, wherein said valve is closed during at least a portion of an outlet stroke of said 4-stroke sequence.

10. An apparatus as set forth in claim 7, wherein said valve is closed during at least a portion of an inlet stroke of said 4-stroke sequence.

11. An apparatus as set forth in claim 7, wherein said valve is closed during at least a portion of a compression stroke of said 4-stroke sequence.

12. An apparatus as set forth in claim 4, wherein said solenoid comprises a fuel shut-off solenoid associated with said carburetor, said fuel shut-off solenoid functioning to shut-off said jet when said engine is not running.

13. An apparatus as set forth in claim 4, wherein said valve control circuitry further comprises an auxiliary power source for selectively delivering an auxiliary flow of current to said solenoid at a lower voltage than said charge capacitor.

14. A method for adjusting air-to-fuel ratio of an internal combustion engine, said method comprising steps of:

providing a valve associated with a jet of a carburetor;

controlling the opening and closing of said valve such that said valve will open during a single combustion sequence of said engine and subsequently close during said single combustion sequence so as to provide fuel flow of limited duration to vary introduction of fuel into said carburetor via said jet; and whereby the air-to-fuel ratio in said carburetor is selectively adjusted by controlling said valve during engine operation.

15. The method as in claim 14, wherein said valve is controlled by operation of a solenoid.

16. The method as in claim 15, wherein energy for operation of said solenoid is supplied by a charge capacitor in an ignition circuit.

17. The method as in claim 14, wherein said solenoid receives an auxiliary flow of current from an auxiliary power source.

18. The method as in claim 15, wherein said solenoid comprises a fuel shut-off solenoid associated with said carburetor, said fuel shut-off solenoid functioning to shut-off said jet when said engine is not running.

19. An apparatus for use with a carburetor on a engine for adjusting air-to-fuel ratio, said apparatus comprising:

at least one carburetor jet;

at least one solenoid associated with said jet, said solenoid controlling a plunger to open and close said jet;

a switching element, said switching element allowing energy to flow into said solenoid;

valve control circuitry operative to vary air-to-fuel ratio in said carburetor by controlling said switching element during engine operation; and said valve control circuitry having a first power source to initiate movement of said plunger at a higher voltage and a second power source to thereafter sustain said plunger at a lower voltage in an open position for a time.

20. An apparatus as set forth in claim 19, wherein said solenoid comprises a fuel shut-off solenoid associated with said carburetor jet, said fuel shut-off solenoid functioning to shut-off said carburetor jet when said engine is not running.

* * * * *